US005171007A

United States Patent [19]

Kasprzak et al.

[11] Patent Number: 5,171,007

[45] Date of Patent: Dec. 15, 1992

[54] SHEET FEEDING DEVICE HAVING AN ADJUSTABLE SHEET RESTRAINER

[75] Inventors: Gregory Kasprzak, Wheeling; Andrew Wierzbicki, Chicago, both of Ill.

[73] Assignee: N & A Custom Metal Service, Inc., Chicago, Ill.

[21] Appl. No.: 734,634

[22] Filed: Jul. 23, 1991

[51] Int. Cl.[5] ..... B65H 3/34

[52] U.S. Cl. ..... 271/104; 271/167

[58] Field of Search ..... 271/104, 106, 167, 169

[56] References Cited

U.S. PATENT DOCUMENTS

| | | | |
|---|---|---|---|
| 678,754 | 7/1901 | McNutt . | |
| 1,861,605 | 6/1932 | Maass | 271/104 |
| 2,070,903 | 2/1937 | Horst | 271/104 |
| 3,471,141 | 10/1969 | Ruetschle . | |
| 3,635,464 | 1/1972 | Gramuch | 271/104 |
| 3,861,668 | 1/1975 | Wood | 271/106 X |
| 4,013,283 | 3/1977 | Tress et al. . | |
| 4,106,765 | 8/1978 | Britt et al. . | |
| 4,358,102 | 11/1982 | Hoshizaki et al. | 271/169 X |
| 4,690,395 | 1/1987 | Nowicki | 271/169 X |

*Primary Examiner*—Robert P. Olszewski
*Assistant Examiner*—Boris Milef
*Attorney, Agent, or Firm*—Niro, Scavone, Haller & Niro

[57] ABSTRACT

An improved sheet feeding device is disclosed for feeding individual sheets separately from a stack into a high-speed press. The device is positioned over a portion of the stack, and includes flexible and moveable springs attached to a base portion, which is adjustably connected to the printer. The individual springs exert a downward pressure on the top sheet of the stack, preventing multiple sheets from being conveyed into the printer at one time.

10 Claims, 5 Drawing Sheets

Fig. 4A
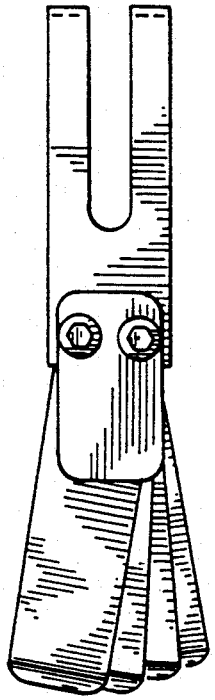
Fig. 4B
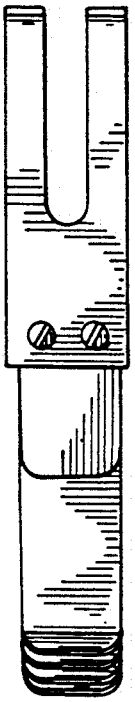
Fig. 4C
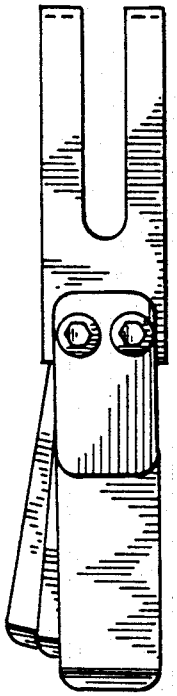
Fig. 4D
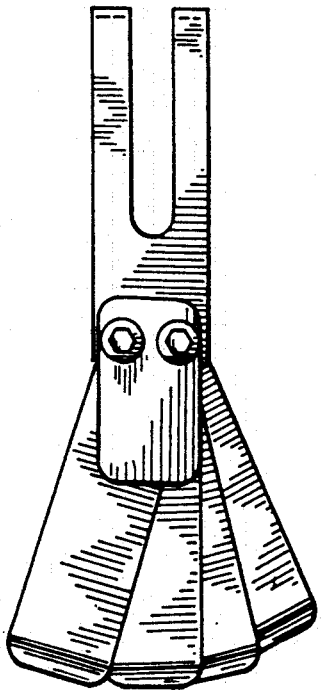
Fig. 4E
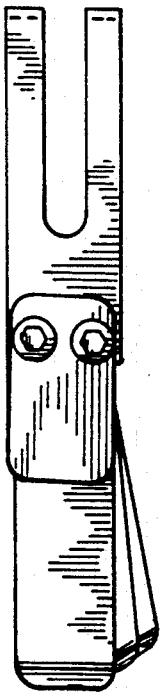
Fig. 4F
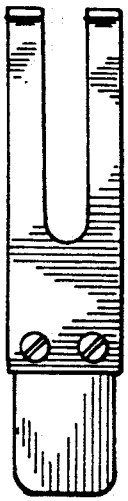
Fig. 4G
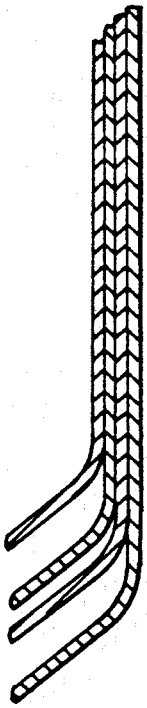
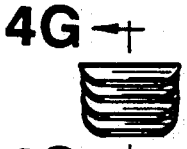
Fig. 4H

SHEET FEEDING DEVICE HAVING AN ADJUSTABLE SHEET RESTRAINER

BACKGROUND OF THE INVENTION

The invention relates generally to an improved sheet feeding device and, more specifically, to a sheet feeding device used in offset or sheet feed printers for separating single sheets from a stack of sheets.

High-speed offset or sheet feed printers, such as the HEIDELBERG SPEEDMASTER® Multicolor Press, the HARRIS ®Press, the KOMORI ®Press, the MIEHLE ®Press and the MAN-ROLAND ®Press, include a reciprocating lifting means, such as a suction device, for lifting a single sheet of paper from a hopper or bin located on the outside portion of the printer, and transferring that sheet to the interior printing section of the printer. However, electrostatically charged paper which tends to stick together often impedes the efforts of the lifting device to select only one sheet of paper at a time per operation from the stack. For this reason, a secondary sheet feeding device has been found necessary to ensure that only one sheet, instead of two or more sheets, is conveyed to the printing means of the printer.

Such an individual sheet feeding apparatus has a variety of benefits. High-speed printing is expensive, and thus extremely costly to the owner when printer operation must temporarily cease due to improper multi-sheet feeding. Moreover, modern high-speed printers maintain precisely set water/ink balances. Sporadic downtime of such printers causes these preset color ratios to be upset, requiring further operator labor and time to reassess and reset the color ratios.

In many prior art printing applications, especially high speed printing applications, high-mass gripper jaw assemblies have been utilized to grasp sheets and pull them from stacks. See, for example, U.S. Pat. No. 4,013,283. However, such gripper jaw assemblies are relatively complicated and tend to experience vibrational and other problems at higher feeding speeds.

Other sheet feeding apparatus have included paper separating devices which are adapted to exert a downward pressure on the top sheet of a stack, thus ensuring that the reciprocating lifting means, such as an air suction device, only delivers one sheet per operation to the feeder and printing means of the press. FIGS. 6 and 7 illustrate two such prior art devices. These devices utilize one stationary metal spring, which is manually adjustable in response to a situational need. However, such prior art devices do not have the necessary flexibility to allow sheets of widely varying thickness to be individually selected. Moreover, such prior art devices do not have the capability of allowing individual springs to be adjusted or fanned out in a number of different positions, depending upon the type or thickness of paper being used.

It is becoming even more important to provide a device which will separate sheets for feeding. Standard paper used in the printing industry has a dimension of 28 wide inches by 40 inches in length. However, new high speed printers now have the capability of accommodating paper sizes of up to 56 inches in length. This increased surface area gives electrostatically charged paper enhanced sticking power.

It is therefore desireable to provide a relatively inexpensive secondary sheet feeding apparatus which would cooperate with a primary sheet feeding apparatus (including lifting means such as an air suction device), and eliminate the problems associated with the prior art devices shown in FIGS. 6 and 7, while providing the desired advantages outlined above, as well as other advantages which will become apparent from reading the more detailed description of the preferred embodiment, below.

SUMMARY OF THE INVENTION

The present invention is generally directed to a sheet feeding mechanism for feeding individual sheets separately from a stack of sheets into a high-speed press, and enables smooth, generally uninterrupted paper feeding. Such a press includes a main hopper assembly for supporting a stack of sheets, a paper feeder for conveying individual sheets to the interior of the printer, and moveable, reciprocating lifting means, such as air suction means, adapted to lift the top sheet on the stack and convey the lifted sheet to a paper feeder.

The present invention more specifically includes a sheet feeding mechanism positioned over a portion of the stack for cooperating with the lifting means and allowing the top sheet to be lifted while maintaining the position of the remainder of the stack. The sheet feeding mechanism has retaining means which include a base portion connected to a plurality of individually moveable springs. The base portion also connects to the printer and is positioned over the stack portion, such that the springs are positioned and adapted to each exert downward pressure on the stack portion as the top sheet is being lifted, thus preventing lifting of more than one sheet in a single operation of the lifting means.

In another embodiment of the sheet feeding mechanism of the present invention, the base portion is adjustably connected to the springs. This adjustable connection allows the springs to be adjustably fanned out from the base portion in any one of a plurality of predetermined and fixed positions.

In still another embodiment of the sheet feeding mechanism of the present invention, each of the springs and the base portion define one or more apertures. Fasteners are provided for passing through these apertures and adjustably securing the springs to the base portion, and for allowing eccentric movement of one or more of the springs with respect to the base portion. This provides predetermined, selective adjustment of the springs in a plane defined by the sheets of paper to be lifted. This allows the sheet feeding mechanism of the present invention to be adjusted to separate virtually any type or thickness of paper. Further adjustment is provided through relative movement of the base with respect to the stack portion, and by also allowing the individual springs to be longitudinally adjusted with respect to the base portion.

In yet another embodiment, the retaining means further includes one or more flexible supporting members lying adjacent to at least a portion of one or more of the springs. Furthermore, more than one retaining means can be provided. In addition, the base portion may be adapted to horizontally slide along a portion of the printer which overhangs the sheet stack portion.

An object, therefore, of the present invention is to provide a relatively simple and inexpensive secondary sheet feeding apparatus, to be used in conjunction with a primary sheet feeding apparatus such as air suction means, for lifting only one sheet from a stack of paper, portions of which may be electrostatically charged or which might otherwise tend to stick together.

A second object of the present invention is to provide a sheet feeding apparatus which is quickly and manually adjustable, and adaptable to separate a variety of paper types and thicknesses.

A third object of the present invention is to provide a reliable and durable sheet feeding apparatus.

A fourth object of the present invention is to provide a reliable and durable sheet feeding apparatus for use with high-speed printers, including printers which feed sheets at the rate of 8,000 sheets/hour or faster.

These objects and other advantages are achieved by the sheet feeding apparatus of the present invention, which will be more specifically described below.

BRIEF DESCRIPTION OF THE DRAWINGS

The novel features of this invention are set forth with particularity in the appended claims. The invention, together with its objects and the advantages thereof, may be best understood by reference to the following description taken in conjunction with the accompanying drawings, in which like reference numerals identify like elements in the figures and in which:

FIG. 4A is a top planar view of an embodiment of the present invention, illustrating the springs of the sheet feeding mechanism located in one position for use;

FIG. 4B is a top planar view of an embodiment of the present invention, illustrating the springs of the sheet feeding mechanism located in a second position for use;

FIG. 4C is a top planar view of an embodiment of the present invention, illustrating the springs of the sheet feeding mechanism located in a third position for use;

FIG. 4D is a top planar view of an embodiment of the present invention, illustrating the springs of the sheet feeding mechanism located in a fourth position for use;

FIG. 4E is a top planar view of an embodiment of the present invention, illustrating the springs of the sheet feeding mechanism located in a fifth position for use;

FIG. 4F is a top planar view of an embodiment of the present invention, illustrating the springs of the sheet feeding mechanism located in a sixth position for use;

FIG. 4G is a cross-sectional view taken along section line G—G.

DETAILED DESCRIPTION OF THE INVENTION

The sheet feeding mechanism of the present invention is designed to act as a secondary feeding member to assist, in conjunction with a primary sheet feeding mechanism such as an air suction device, as described above, in properly and efficiently feeding paper within a printer. Both of these sheet feeding members cooperate to lift an individual top sheet from a sheet stack and convey the top sheet to feeder located within the press. The secondary feeding mechanism ensures that the sheets below the top sheet will be retained in a proper position on the sheet stack during the operation of the primary sheet feeding mechanism.

Figure 5:
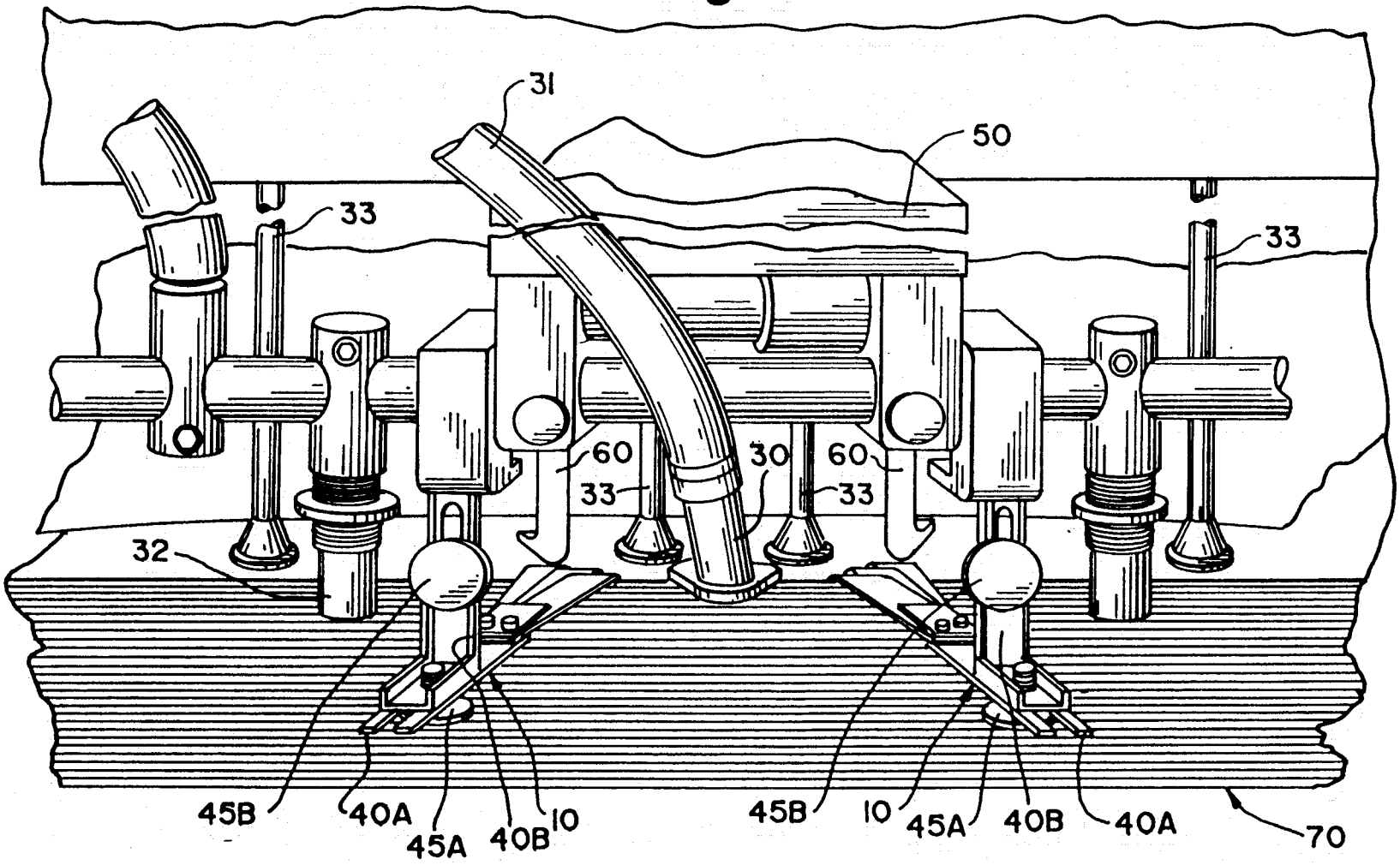
FIG. 5 is an enlarged side perspective view of one embodiment of the present invention, illustrating the portion of FIG. 1 which includes the air blower and suction lifting devices, the portion of the printer overhanging the back edge of the paper stack, and the attachment and orientation of the sheet feeding mechanism in relation to the printer.

Referring now to FIG. 5, a primary sheet feeding mechanism in a typical high speed printer will now be more specifically described. This mechanism includes press portion 50, which overhangs the back edge of sheet stack 70, sheet separator blowers 32, governor foot 30, air suction devices 33, and presser feet 60. Air hose 31 is connected to governor foot 30. Sheet stack 70 is placed within hopper or bin 50 below press portion 50. While the printer requires the feeding of individual sheets from a feeder drive (not shown), air suction devices 33 can, and often do, pick up more than one sheet at a time. This can occur because the sheets are electrostatically charged from the manufacturer. The sheets may also contain imperfections, ragged or serrated edges, or foreign substances which may cause the sheets to stick together. Additionally, paper containing glue or adhesive, such as carbon paper, may first be stored in relatively high temperatures which can cause the adhesive to adhere between separate sheets. Accordingly, the present invention allows individual sheets of paper to be properly delivered and fed into the printer.

To operate a typical high speed printer, an operator initially activates the feeder drive. When this occurs an electromagnetic clutch engages the feeder drive with the press. A microswitch (not shown) located above press portion 50 is also activated, causing bin 70 and sheet stack 70 to move upward into a proper sheet feeding position about one-half inches below sheet feeding device 10. In this fashion, sheet feeding mechanism 10, as well as air suction device 30, can each be maintained a predetermined distance vertically above and projecting a distance over the back edge of the top sheet of stack 70. (Typically, a second microswitch controls an intermediate movement of floor 81 of bin 80 which protects the relatively fragile sheet feeding and blowing devices on press portion 50 from being damaged by the upward engaging movement of sheet stack 70.) Air suctions devices 33 communicate with an air valve connected to a compressor also located above press portion 50 (not shown), as is well known in the art. The air valve opens and closes in synchronization with the feeder drive, and controls the flow of air through air suction devices 33. This air intermittently flows as each sheet feeding operation occurs.

In operation, then, once the feeder drive is activated and engaged with the press, and sheet stack 70 is properly positioned beneath press portion 50, the sheet feeding operation can begin. Still referring to FIG. 5, air suction devices 33 move first downward vertically, and then horizontally, in a cyclical, reciprocating fashion, lifting the top sheet from sheet stack 70, and conveying this sheet away from the sheet feeding devices 10 and toward the press interior. For each sheet feed operation, each of sheet separator blowers 32 and governor foot 30 intermittently blow air in a horizontal direction into the side of the top portion of the sheet stack, aiding in the separation of the top sheets of stack 70. After air suction devices 33 and sheet feeding device 10 have cooperated, as will be explained below, to separate the top sheet of stack 70 and convey it to the feeder for further conveyance to the press interior, presser feet 60 move vertically downward compact stack 70. This periodic compaction after each sheet feed operation maintains the back edges of the individual sheets of stack 70 in a proper position, preventing the edges from folding over under the influence of blown air from sheet separator blowers 32 and governor foot 30.

Figure 1:
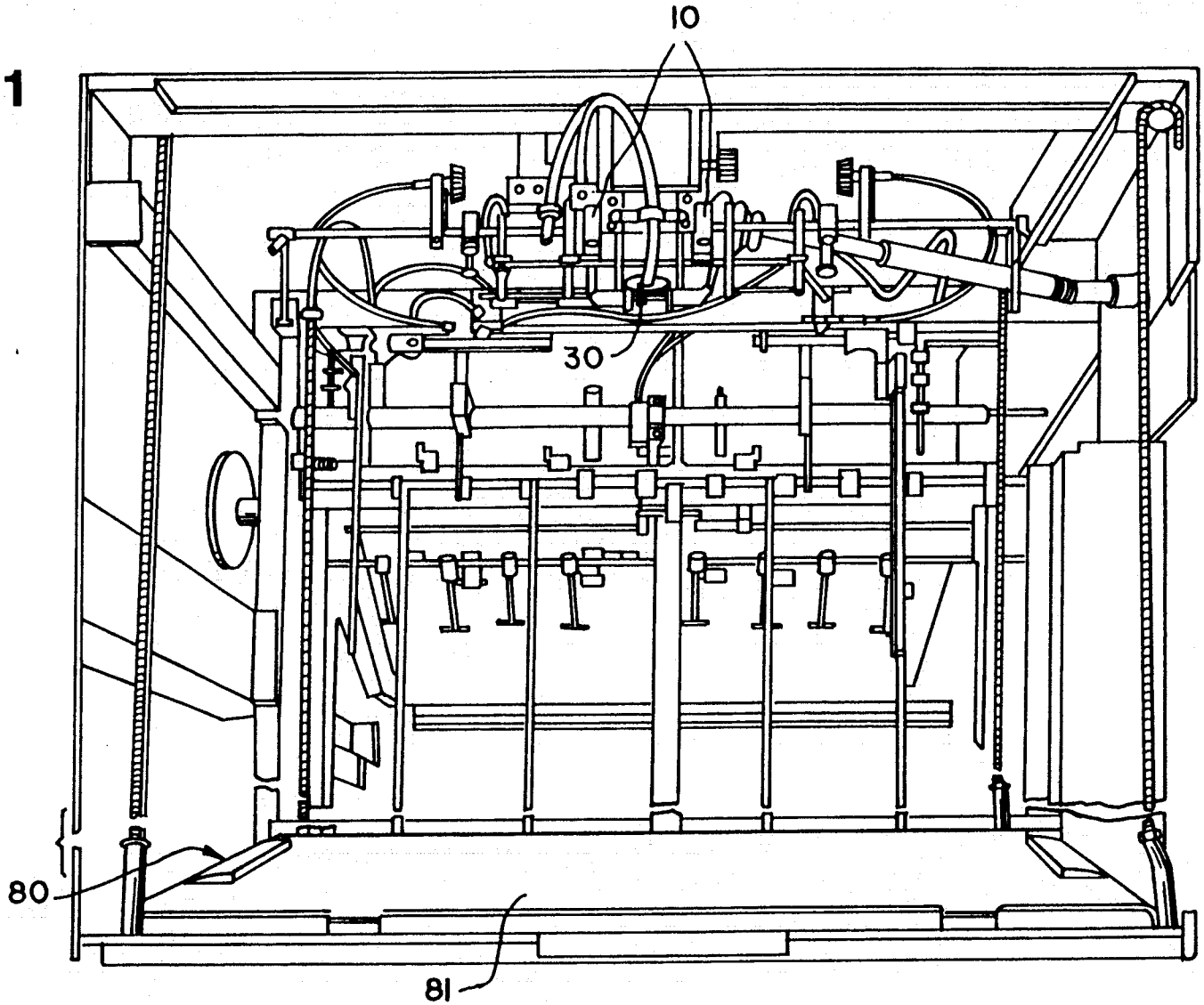
FIG. 1 is a top perspective view of a typical high speed offset printer.
Figure 2:
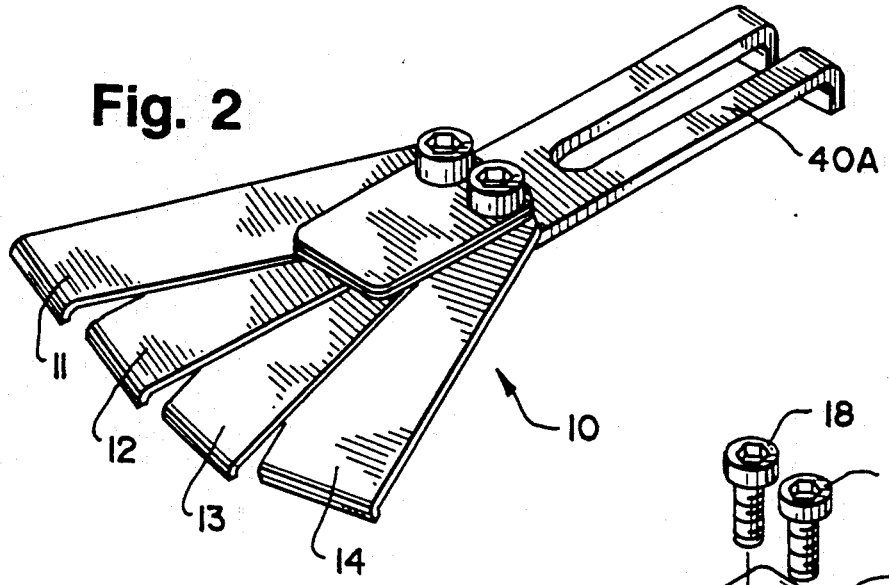
FIG. 2 is a side perspective view of the sheet feeding mechanism of the present invention, fully assembled.

Referring now to the preferred embodiment shown in FIG. 2, the sheet feeding mechanism of the present invention, generally designated as 10, has a plurality of biased and flexible metal springs 11–14, which are secured to a base portion, such as lower bracket 40A. Lower bracket 40A includes two threaded apertures at one end, whose use will be described below. Lower bracket 40A is positioned on the sheet feed side of the springs 11–14, and is manually and adjustably connected to upper bracket 40B by thumb screw 45A; by loosening and tightening thumb screw 45A, while adjusting lower bracket 40A, lower bracket 40A can be moved in a horizontal plane. Upper bracket 40B is connected to a lower portion of press portion 50. Identical thumb screw 45B is used to adjustably connect upper bracket 40B to press portion 50; upper bracket 40B can be adjusted in a vertical plane by adjusting thumb screw 45B.

Figure 3:
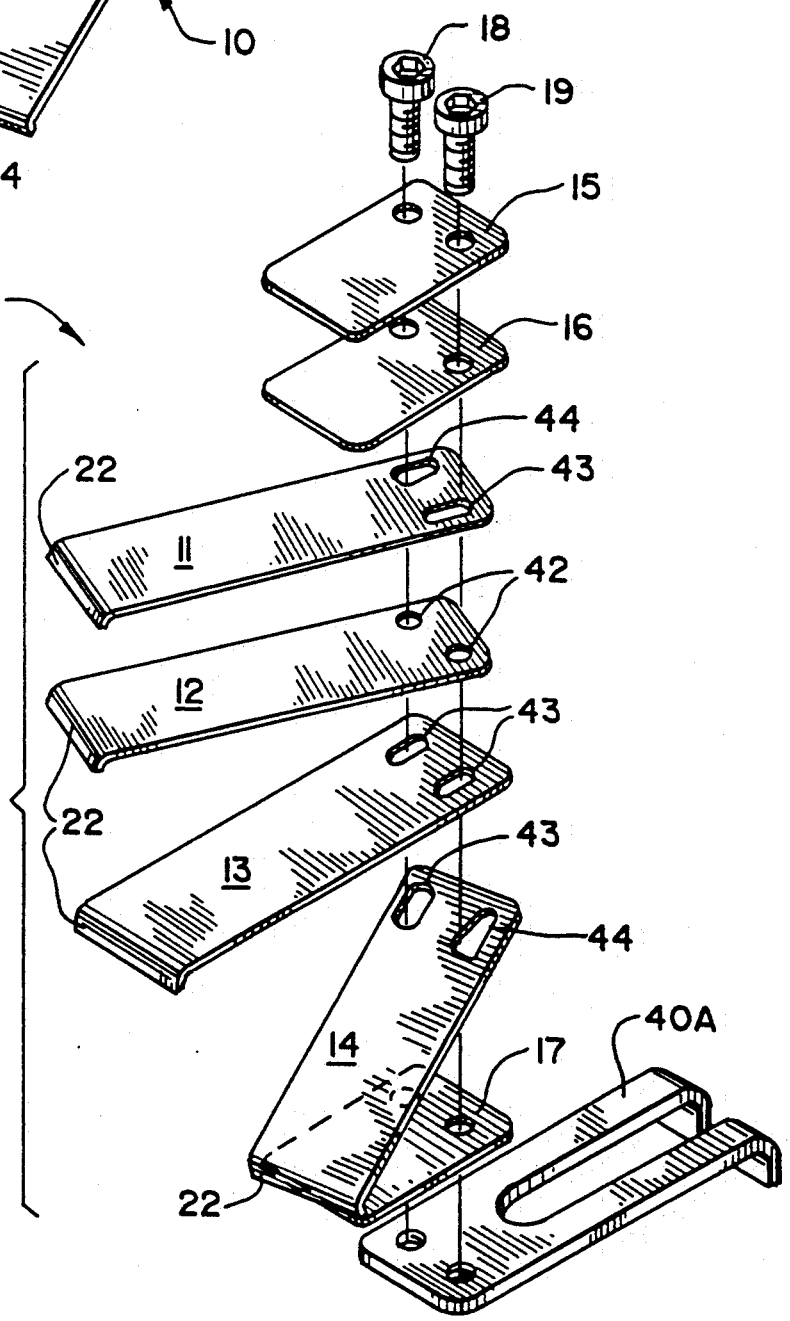
FIG. 3 is an exploded side perspective view of various parts of the sheet feeding mechanism of the present invention, showing the assembly of such parts.

Each of springs 11–14 of sheet feeding mechanism 10 employ bent edges 22, which enhance the ability of the springs to select individual sheets of paper. Metal supporting members 15–17 are adapted to surround and support springs 11-14 from above and below. In the preferred embodiment, seven blades, three supporting members 15–17, and four springs 11–14, are used. FIG. 3 illustrates the assembly of the various parts of the preferred embodiment of the present invention. Allen head screws are adapted to be inserted through the apertures on each of the supporting members 15–17 and springs 11–14, and into the threaded apertures on lower bracket 40A, thus securing these elements together after proper tightening of screws 18 and 19.

A variety of positions is available for the adjustable sheet feeding mechanism 10 of the present invention. Some of these positions include, but are not limited to, those illustrated in FIGS. 4A–4F of the drawings. Each position shown in FIGS. 4A–4F represents a different embodiment for a distinct use, as will be described immediately below. To change from one position to another, allen head screws 18 and 19 are loosened with a suitable allen head wrench, and the individual springs are quickly and easily manually adjusted and fanned-out from lower bracket 40A into the desired positions. Individual springs 11–14 preferably decrease slightly in length, with spring 11 being the longest, and spring 14 being the shortest. This descending decrease in length enables springs 11–14 to present a generally unified, fanned position for meeting and engaging the back edge of the sheets.

FIG. 4A, the "Turbo" position, is the universal sheet feeding mechanism position. It has been found that when sheet feeding mechanism 10 is positioned in the "Turbo" position, it can be used to separate sheets for most offset stock paper or reflective paper, as well as light labor stock paper, heavy plastic paper, and foil. However, should an operator encounter a sheet feeding problem with sheet feeding mechanism 10 in the "Turbo" position, one of the specialized applications mentioned below can be used.

FIG. 4B, the "graduated layer" position, is positioned with approximately between 0.04 and 0.06 inches between adjacent spring edges. This sheet feeding mechanism position yields beneficial results when used with bristol paper, plastics, all types of foils, carbon paper of any poundage, and paper with thicknesses of about less than 3 points, or 0.003 inches (0.15 mm). It has been found that when a press is running at more than 8,500 sheets per hour, and the "graduated layer" position is used with very light paper, more beneficial results can often be obtained if the operator moves sheet feeding device 10 slightly upward and/or horizontally away from stack 70, while at the same time decreasing the air flow from blowers 32 and foot 30. This adjustment will facilitate the circulation of air between the sheets (since springs 11–14 are not pressing downward with as much force) while also allowing the back edges of these light sheets to maintain a proper position, without excessive flapping.

FIG. 4C, shows the sheet feeding mechanism 10 in the semi-fanned-out right position, while FIG. 4E illustrates the "semi- fanned-out left" position. These two sheet feeding mechanisms are used together in adjacent and complementary positions, designated as the "split" position; referring to FIG. 5, the "semi-fanned-out left" position is used on the left side of press portion 50, while the "semi-fanned-out right" position is used on the right side of press portion 50. (One of the springs in each of FIGS. 4C and 4E is hidden behind the straight, non-angled spring.) These respective positions are preferred because of enhanced operation; if these respective positions were reversed, the sheets below the top sheet of stack 70 would interfere with the angled springs. Beneficial results have been obtained when the "split" position is used with label paper of virtually any poundage, such as with electrostatically charged label cardboard of 12 points (0.012 inches) or greater in thickness, plastic label or carton label. Aluminum foil can also be used in the "split" position.

FIGS. 4F and 4G illustrate sheet feeding mechanism 10 in the "heavy" or "layered" position. The only difference between the "layered" position and the "graduated layer" position is that in the "layered" position, the individual springs 11–14 have been moved as close together as possible, so that bent edges 22 abut or nearly abut, each other. With the "graduated layer" position, on the other hand, springs 11–14 have been positioned so that there is a spaced distance between bent edges 22 of each of springs 11–14. This longitudinal adjustment of springs 11–14 with respect to lower bracket 40A is made possible both by the graduated spring length as well as by the varying circular and elongated, oval-shaped apertures utilized by springs 11–14, and shown in FIG. 3. The "layered" position has found beneficial use with virtually any type of cardboard, cartons or plastic of greater than 12 points in thickness.

FIG. 4D shows the sheet feeding mechanism 10 in the "maximum fanned" position. This position has found beneficial use with virtually any decorative or "deco" paper (e.g., napkins having small protuberances or bumps on the outer surface), as well as with serrated paper (paper having non-straight edges, including paper with uneven edges in which the edges of adjacent sheets do not interlock). In this position, the springs will not press as heavily against the paper as in the "Turbo" position, and should not be positioned to do so. More beneficial use has been obtained when using two or even four sheet feeding mechanisms, positioned closer together for relatively lighter paper, and spaced farther apart for relatively heavier paper or cardboard.

It has been found that pairs of two or four sheet feeding devices 10 can be used to obtain more beneficial results when, for example, highly electrostatically charged paper is being used. Further, when two pairs of sheet feeding mechanisms 10 are used, the need for fixed brushes, which some high speed printers use in the same location as sheet feeding mechanisms 10, is obviated. It has also been found that more beneficial results can be obtained, if the sheet feeding devices 10 are mounted closer together when working with light paper, and farther from each other when working with heavy paper, such as thick cardboard. Also, less than four springs in an individual sheet feeding device 10 could be used for specialized applications in which enhanced spring flexibility would be beneficial, while more than four springs could be used for applications that require more spring stability and increased holding power. Furthermore, the number of supporting members may be decreased or increased in a corresponding fashion.

When using certain paper under some high speed printing applications, and especially when the press is running in excess of about 8,500 sheets/minute, enhanced sheet separation can be derived by manually adjusting bracket 40 of sheet feeding mechanism 10 so that the device is horizontally moved in a direction toward the paper stack, allowing the springs to project over a greater or lesser portion of the back edge of the stack. A similar result can be achieved by adjusting upper bracket 40B to vertically adjust the position of sheet feeding device 10. Sheet separation at certain speeds and with certain applications can also be aided by decreasing the flow of air through sheet separator blowers 32 and governor foot 30, as mentioned above.

In operation, and referring now to FIGS. 3 and 5, the individual metal springs 11–14 of sheet feeding mechanism 10 project over the top of the back edge of stack 70 a distance of preferably about one-half inches above the top sheet of stack 70. The springs are biased in a downward direction, so that as the top sheet if lifted by air suction grippers 33 above spring edges 22, individual springs 11–14 snap underneath the top sheet, and engage the next sheet to prevent it from being lifted along with the top sheet of stack 70. Individual springs 11–14 are secured to base portion or lower bracket 40A, which is rigidly secured to bracket 40A, and thus press portion 50. The individual springs are also supported by surrounding supporting members 15–16 and 17. Two supporting members 15 and 16 are provided above spring 11, while only one supporting member 17 is provided below spring 17. This construction has proved beneficial since springs 11–14 require more support against biasing in the upward direction, which is the normal biasing direction.

The adjustable movement of springs 11–14 will now be described. Referring again to FIG. 3, each of springs 11–14 are provided with one or more generally oval-shaped apertures 43 at their ends, while spring 12 is provided with two circular aperatures 42 which serve to maintain this spring in a relatively straight direction, generally parallel to base portion 20. The use of straight elongated, oval apertures 43, together with elongated, angled and generally oval aperaturs 44, as with springs 11 and 14, allows at least one of springs 11 or 14 to be moved eccentrically with respect to lower bracket 40A and at least one of said springs 12, 13 or 14. Elongated apertures 43 and 44 also permit a small amount of longitudinal movement of springs 11, 13 and 14 toward or away from lower bracket 40A. Accordingly, through selective eccentric movement of one or more of springs 11–14, springs 11–14 can be selectively positioned as shown in FIGS. 4A–4F, and can also be positioned in other configurations not shown in the drawings.

Figure 6:
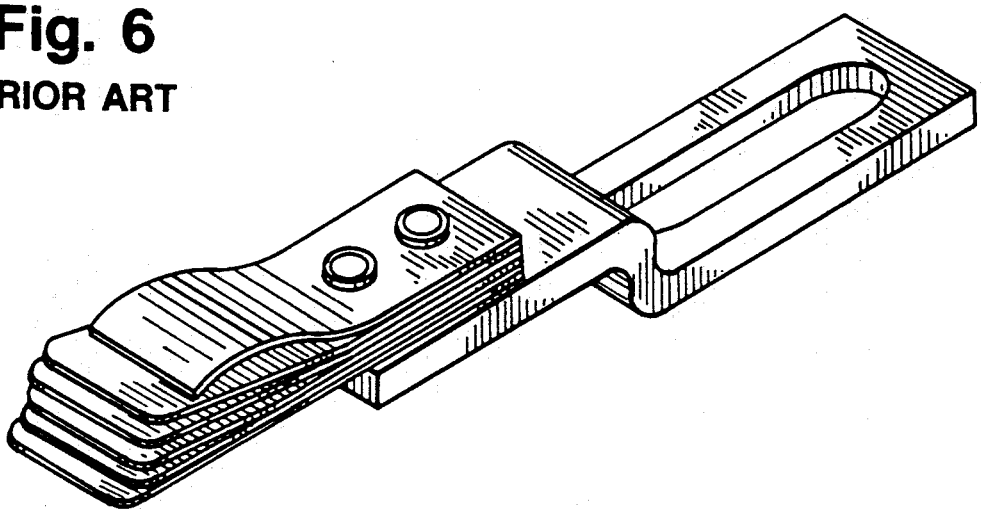
Fig. 6 PRIOR ART
FIG. 6 is a side perspective view of one prior art device.
Figure 7:
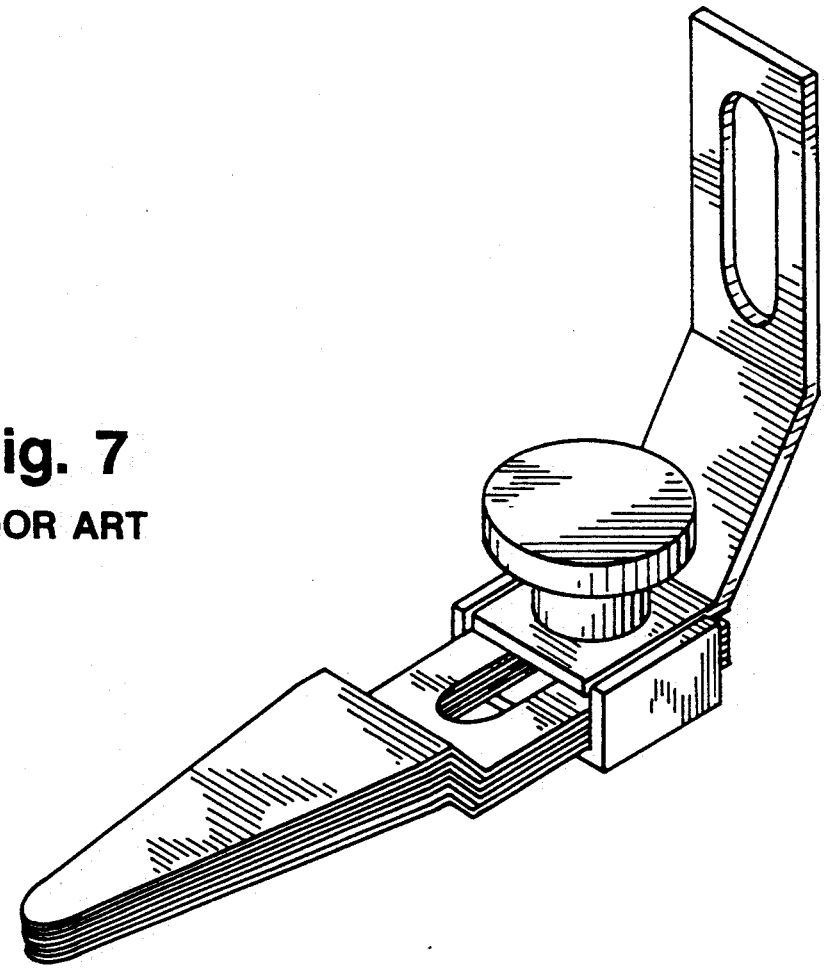
Fig. 7 PRIOR ART
FIG. 7 is a side perspective view of a second prior art device.

When sheet feeding mechanism 10 is in the "Turbo" or universal position, the peripheral contact edge length of springs 11–14 is about 1.5 inches, whereas the contact edge length of prior art springs, such as those shown in FIGS. 6 and 7, is about 0.5 inches. Since springs 11–14 of the present invention are contacting the back edge of sheet stock 70 over an extended length, sheet feeding mechanism 10 of the present invention develops an enhanced frictional contact area and thus better grasping action on the paper edge. Bent edges 22 of each of springs 11–14 also aid in providing a sheet feeding device 10 with superior sheet grasping ability.

The preferred embodiment of the sheet feeding mechanism 10 of the present invention utilizes feeler guage stock steel having a thickness of about 0.008 inches for supporting members 15–17, and about 0.006 inches for springs 11–14. Blades made from this steel have been found to be more flexible than prior art blades, while retaining more than adequate strength and durability. Of course, any flexible and resilient metal can be used for the springs and supporting members, including other thicknesses of spring steel. The steel should preferably undergo a deburning tumbling process to provide a smooth surface devoid of any sharp edges. Metal blades are preferably used, as metal will pick up some of the static from the electrostatically charged sheets, whereas another material (such as rubber) would repel the static, and fail to effectively separate the top sheet from a stack.

Of course, it should be understood that various changes and modifications to the preferred embodiments described herein will be apparent to those skilled in the art. Such changes and modifications can be made without departing from the spirit and scope of the present invention and without diminishing its attendant advantages. It is, therefore, intended that such changes and modifications be covered by the following claims.

We claim:

1. A sheet feeding mechanism for feeding individual sheets separately from a stack into a high-speed press, the press including a main hopper assembly for supporting a stack of sheets, and movable, reciprocating lifting means for lifting the top sheet of the stack, comprising:

retaining means positioned over a portion of the stack for cooperating with the lifting means and allowing the top sheet to be lifted while maintaining the position of the remainder of the stack, said retaining means including a base portion adjustably connected to a plurality of moveable springs, thereby allowing said springs to be adjustably fanned-out from the base portion in any one of a plurality of positions, said base portion also connected to the press and positioned over said stack portion, such that said springs each exert a downward pressure on said stack portion as the top sheet is being lifted, thereby preventing lifting of more than one sheet in a single operation of the lifting means.

2. The sheet feeding mechanism of claim 1, wherein said retaining means further comprises three flexible supporting members and a stack of four of said springs, two of said supporting members lying above a top spring, and one of said supporting members lying below a bottom spring.

3. The sheet feeding mechanism of claim 2, wherein each of said springs and said supporting members are feeler gauge stock steel.

4. The sheet feeding mechanism of claim 3, wherein each of said springs have a thickness of about 0.006 inches, and each of said supporting members have a thickness of about 0.008 inches.

5. The sheet feeding mechanism of claim 1, wherein said retaining means includes at least one fastener, each of said springs and said base portion each defining at least one aperture, and said fastener being adapted to secure said base portion to said springs, said apertures allowing eccentric movement of at least one of said springs with respect to said base portion.

6. The sheet feeding mechanism of claim 5, wherein four stacked springs are used, and the first, third and fourth springs, in order of descent, each define at least one aperture to allow eccentric movement of said first, third and fourth springs.

7. The sheet feeding mechanism of claim 1, further including means for allowing eccentric movement of at least one of said springs with respect to said base portion.

8. A sheet feeding mechanism for feeding individual sheets separately from a stack into a high-speed press, the press including a main hopper assembly for supporting a stack of sheets, and reciprocating suction means for lifting the top sheet of the stack, comprising:

retaining means positioned over a portion of the stack for cooperating with the suction means and allowing the top sheet to be lifted while maintaining the position of the remainder of the stack, said retaining means including a base portion having first and second ends, said first end connected to the press and positioned over said stack portion, and said retaining means further including a plurality of moveable springs;

at least one fastener adapted to adjustably secure said second end of said base portion to said springs, said springs each being positioned and adapted to exert a downward pressure on said stack portion as the top sheet is being lifted, thereby preventing lifting of more than one sheet in a single operation of the suction means; and means for allowing eccentric movement of at least one of said springs with respect to said base portion.

9. A sheet feeding mechanism for feeding individual sheets separately from a stack into a high-speed press, the press including a main hopper assembly for supporting a stack of sheets, and reciprocating suction means for lifting the top sheet of the stack, comprising:

retaining means positioned over a portion of the stack for cooperating with the suction means and allowing the top sheet to be lifted while maintaining the position of the remainder of the stack, said retaining means including a base portion having first and second ends, said first end being connected to the press and positioned over said stack portion, and said retaining means further including a plurality of moveable springs, and means for eccentrically moving at least one of said plurality of moveable springs;

means for adjustably securing said second end of said base portion to said plurality of moveable springs, said adjusting means allowing eccentric movement of at least one of said plurality of moveable springs with respect to at least one other of said plurality of moveable springs and thereby enabling said springs to be adjusted with respect to said base portion in any one of a plurality of predetermined and fixed positions, whereby each of said springs are positioned and adapted to exert a downward pressure on said stack portion as the top sheet is being lifted, thereby preventing lifting of more than one sheet in a single operation of the suction means.

10. The sheet feeding mechanism of claim 9, wherein more than one retaining means is used.

* * * * *